US008121259B2

(12) United States Patent
Hebert et al.

(10) Patent No.: US 8,121,259 B2
(45) Date of Patent: Feb. 21, 2012

(54) THERMAL ENERGY STORAGE AND TRANSFER ASSEMBLY AND METHOD OF MAKING SAME

(75) Inventors: Michael Scott Hebert, Franklin, WI (US); Gregory Alan Steinlage, Hartland, WI (US); Madhusudhana T. Subraya, New Berlin, WI (US); Donald Robert Allen, Waukesha, WI (US); James J. Van Bogart, Ixonia, WI (US)

(73) Assignee: General Electric Company, Schenectady, NY (US)

( * ) Notice: Subject to any disclaimer, the term of this patent is extended or adjusted under 35 U.S.C. 154(b) by 305 days.

(21) Appl. No.: 12/630,326

(22) Filed: Dec. 3, 2009

(65) Prior Publication Data

US 2011/0135067 A1 Jun. 9, 2011

(51) Int. Cl.
*H01J 35/10* (2006.01)

(52) U.S. Cl. ..... 378/141; 378/140

(58) Field of Classification Search ..... 378/121, 378/122, 127, 140, 141; 445/28
See application file for complete search history.

(56) References Cited

U.S. PATENT DOCUMENTS 6,215,852 B1 4/2001 Rogers et al.
6,301,332 B1 10/2001 Rogers et al.
6,714,626 B1 3/2004 Subraya et al.
6,980,628 B2 12/2005 Wang et al.

*Primary Examiner* — Jurie Yun
(74) *Attorney, Agent, or Firm* — Ziolkowski Patent Solutions Group, SC

(57) ABSTRACT

An apparatus includes an electron collector includes a body having an internal bore formed therethrough along a first direction and a window side having an aperture formed in a first portion thereof along a second direction different from the first direction. The apparatus also includes a cover plate having a bottom surface coupled to a second portion of the first surface of the electron collector, and an x-ray transmission window coupled to the cover plate and aligned with the aperture along the second direction, wherein a recess is formed along the second direction in one of the first portion of the first surface of the electron collector and a portion of the bottom surface of the cover plate, and wherein a gap is formed between the bottom surface of the cover plate and the first surface of the electron collector.

21 Claims, 7 Drawing Sheets

THERMAL ENERGY STORAGE AND TRANSFER ASSEMBLY AND METHOD OF MAKING SAME

BACKGROUND OF THE INVENTION

Embodiments of the invention relate generally to a thermal management system, and more particularly, to a thermal energy storage and transfer assembly for gathering and dispersing radiant thermal energy and kinetic energy of electrons, such as within an electron beam generating device.

Electron beam generating devices, such as x-ray tubes and electron beam welders, operate in a high temperature environment. Typically, an x-ray beam generating device or x-ray tube comprises opposed electrodes, a cathode and an anode, enclosed within a cylindrical vacuum vessel. A hot cathode filament emits thermal electrons that are accelerated across a typical voltage difference of 20 kV to 200 kV and impact the target zone of the anode at high velocity. The primary electron beam generated by the cathode deposits a very large heat load in the anode target to the extent that the target glows red-hot in operation. The x-rays are emitted in all directions, emanating from the focal spot, and may be directed out of the vacuum vessel. In an x-ray tube having a metal vacuum vessel, for example, an x-ray transmissive window is fabricated into the metal vacuum vessel to allow the x-ray beam to exit at a desired location.

However, less than 1% of the primary electron beam energy is converted into x-rays. The balance of the beam energy is contained in back scattered electrons or converted to heat. This thermal energy from the hot target is radiated to other components within the vacuum vessel of the x-ray tube. Additionally, some of the electrons back scatter from the target and impinge on other components within the vacuum vessel, causing additional heating of the x-ray tube. As a result of the high temperatures caused by this thermal energy, the x-ray tube components are subject to high thermal stresses.

Since the production of x-rays in a medical diagnostic x-ray tube is by its nature a very inefficient process, the components in x-ray generating devices operate at elevated temperatures. For example, the temperature of the anode focal spot can run as high as about 2700° C., while the temperature in the other parts of the anode may range up to about 1800° C.

The excessive temperatures that build up within the x-ray tube can decrease the life of the transmissive window, as well as other x-ray tube components. Due to its close proximity to the focal spot, the x-ray transmissive window is subject to very high heat loads resulting from thermal radiation and back scattered electrons. The high heat loads cause very large and cyclic stresses in the transmissive window and can lead to premature failure of the window and its hermetic seals.

Some methods to address thermal loads in x-ray tubes rely on quickly dissipating thermal energy by using a circulating, coolant fluid within structures contained in the vacuum vessel. Other methods have been proposed to electromagnetically deflect back scattered electrons so that they do not impinge on the x-ray window. These approaches, however, often do not adequately minimize thermal stress on the transmissive window.

Therefore, it would be desirable to design an thermal energy management and transfer assembly that thermally and mechanically isolates the transmissive window in order to minimize thermal stress on the transmissive window.

BRIEF DESCRIPTION OF THE INVENTION

In accordance with one aspect of the invention, an apparatus includes an electron collector includes a body having an internal bore formed therethrough along a first direction and a window side having an aperture formed in a first portion thereof along a second direction different from the first direction. The apparatus also includes a cover plate having a bottom surface coupled to a second portion of the first surface of the electron collector, and an x-ray transmission window coupled to the cover plate and aligned with the aperture along the second direction, wherein a recess is formed along the second direction in one of the first portion of the first surface of the electron collector and a portion of the bottom surface of the cover plate, and wherein a gap is formed between the bottom surface of the cover plate and the first surface of the electron collector.

In accordance with another aspect of the invention, a method of fabricating an assembly includes providing a thermal storage body having a bore formed therein in a first direction to allow an electron beam to pass therethrough and having a window side surface oriented parallel to a central axis of the bore, wherein the window side surface comprises a first portion and a second portion, and wherein an aperture is formed between the bore and the second portion of the window side surface. The method also includes coupling a first portion of a bottom surface of a cover plate to the first portion of the window side surface of the thermal storage body such that an internal pocket is formed between a second portion of the bottom surface of the cover plate and the second portion of the window side surface of the thermal storage body, and disposing an x-ray transmission window in the cover plate.

In accordance with another aspect of the invention, an apparatus includes a vacuum chamber, a cathode positioned within the vacuum chamber and configured to emit electrons, and an anode positioned within the vacuum chamber to receive the electrons emitted from the cathode and configured to generate a beam of x-rays from the electrons. The apparatus also includes an electron collector configured to allow passage of the beam of x-rays therethrough. The electron collector includes a collector body having an anode side, a cathode side, and a window side adjacent to the anode and cathode sides, wherein a bore is formed between the anode side and the cathode side, and wherein the window side comprises a window surface having a first portion and a second portion, the second portion having an aperture formed therein. The electron collector also includes a plate having a first surface portion and a second surface portion, wherein the first surface portion is coupled to the first portion of the window surface of the collector body, and wherein a vacuum gap is formed between the second surface portion of the plate and the second portion of the window surface of the collector body, and a window disposed in the plate and positioned to allow a portion of the beam of x-rays to pass therethrough.

Various other features and advantages will be made apparent from the following detailed description and the drawings.

BRIEF DESCRIPTION OF THE DRAWINGS

The drawings illustrate several embodiments presently contemplated for carrying out the invention.

In the drawings.

DETAILED DESCRIPTION

The operating environment of embodiments of the present invention is described with respect to a sixty-four-slice computed tomography (CT) system. However, it will be appreciated by those skilled in the art that the present invention is equally applicable for use with other multi-slice configurations. Moreover, the present invention will be described with respect to the detection and conversion of x-rays. However, one skilled in the art will further appreciate that the present invention is equally applicable for the detection and conversion of other high frequency electromagnetic energy. The present invention will be described with respect to a "third generation" CT scanner, but is equally applicable with other CT systems.

Figure 1:
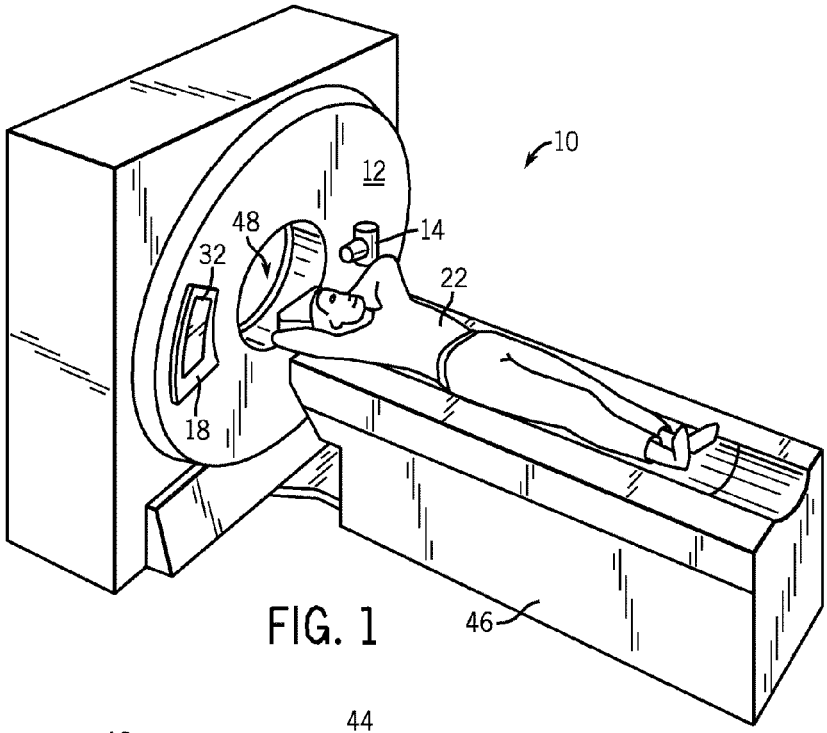
FIG. 1 is a schematic diagram of an imaging system that can benefit from incorporation of embodiments of the invention.
Figure 2:
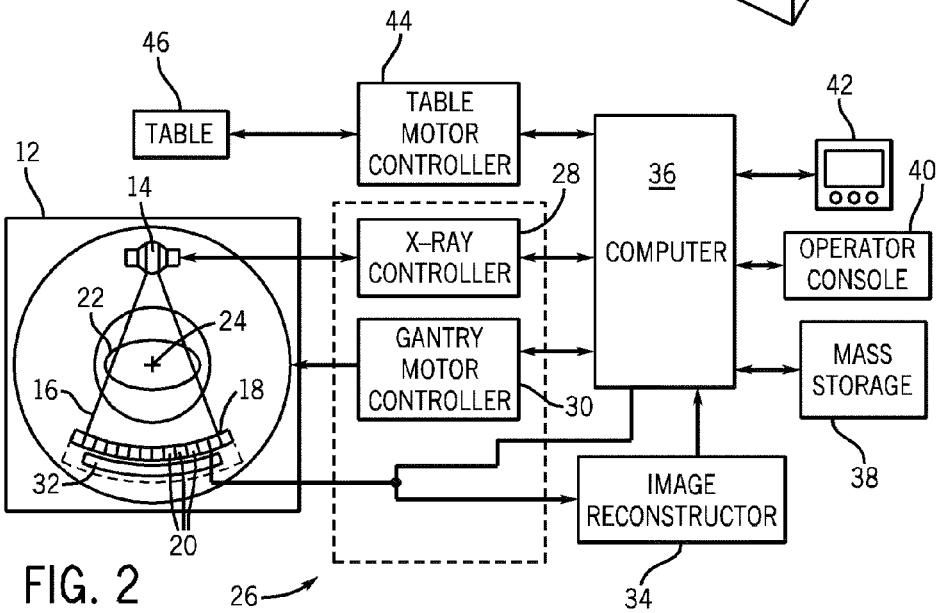
FIG. 2 is a schematic block diagram of an imaging system that can benefit from incorporation of embodiments of the invention.

Referring to FIG. 1, a computed tomography (CT) imaging system 10 is shown as including a gantry 12 representative of a "third generation" CT scanner. Gantry 12 has an x-ray source 14 that projects a beam of x-rays 16 toward a detector assembly or collimator 18 on the opposite side of the gantry 12. Referring now to FIG. 2, detector assembly 18 is formed by a plurality of detectors 20 and data acquisition systems (DAS) 32. The plurality of detectors 20 sense the projected x-rays that pass through a medical patient 22, and DAS 32 converts the data to digital signals for subsequent processing. Each detector 20 produces an analog electrical signal that represents the intensity of an impinging x-ray beam and hence the attenuated beam as it passes through the patient 22. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to an x-ray source 14 and a gantry motor controller 30 that controls the rotational speed and position of gantry 12. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has some form of operator interface, such as a keyboard, mouse, voice activated controller, or any other suitable input apparatus. An associated display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 and gantry 12. Particularly, table 46 moves patients 22 through a gantry opening 48 of FIG. 1 in whole or in part.

Figure 3:
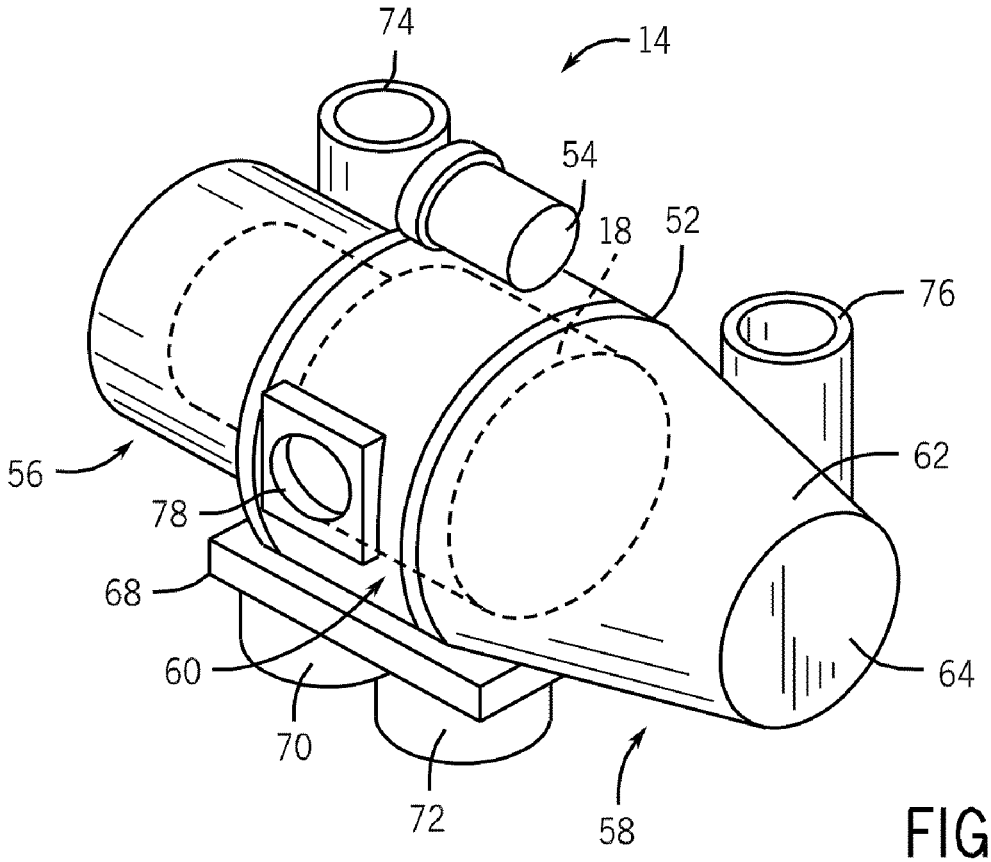
FIG. 3 is a perspective view of an x-ray tube assembly incorporating a electron collector assembly in accordance with an embodiment of the present invention.

Referring now to FIG. 3, a perspective view of the x-ray tube assembly 14 incorporating a thermal storage body or electron collector 11 is illustrated in accordance with one embodiment of the present invention. The tube assembly 14 includes a housing unit 52, a coolant pump 54, an anode end 56, a cathode end 58, and a center section 60 positioned between the anode end 56 and cathode end 58, which contains the x-ray tube 18. The x-ray tube 18 is enclosed in a fluid chamber 62 within lead-lined casing 64. The chamber 62 is typically filled with fluid, such as dielectric oil, but other fluids including water or air may be utilized. The fluid circulates through housing 52 to cool the x-ray tube 18 and may insulate casing 64 from high electrical charges within the x-ray tube 18.

Figure 4:
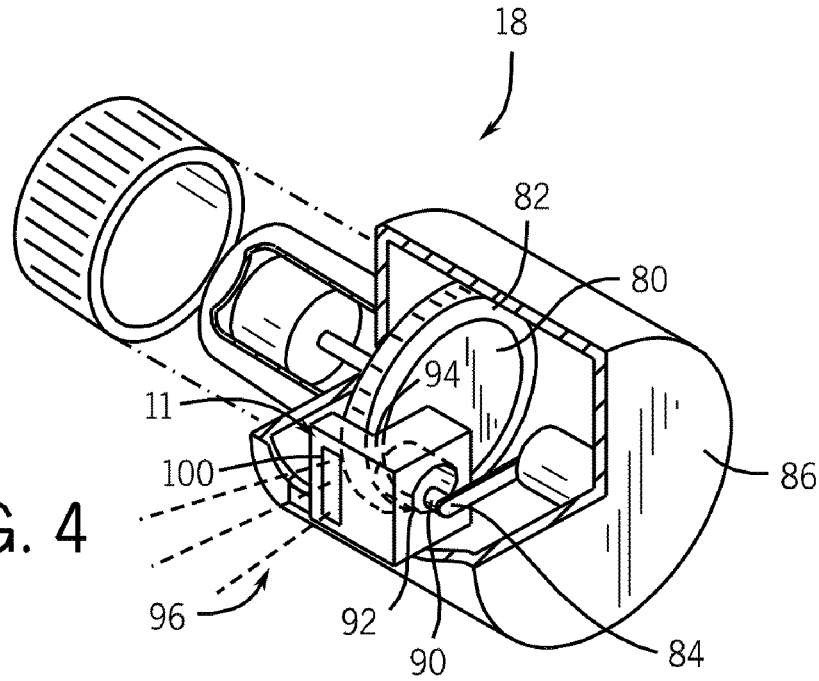
FIG. 4 is a sectional perspective view of an x-ray tube incorporating an electron collector assembly in accordance with an embodiment of the present invention.

Referring now to FIG. 4, a sectional perspective view of the x-ray tube 18 incorporating electron collector 11 is shown in accordance with an embodiment of the present invention. The x-ray tube 18 includes a rotating anode 80 having a target 82 and a cathode assembly 84 disposed in a vacuum within a vacuum vessel 86. Electron collector 11 is interposed between anode 80 and cathode assembly 84. Upon energization of the electrical circuit connecting cathode assembly 84, a stream of electrons 90 are directed through an internal bore 92 of electron collector 11 and accelerated toward target 82. The stream of electrons 90 strike a focal spot 94 on target 82 and produce high frequency electromagnetic waves 96, or x-rays, and residual energy. The residual energy is absorbed by the components within x-ray tube 18 as heat. X-rays 96 are directed through the vacuum toward an x-ray transmission window 100 in electron collector apparatus 11, which efficiently allows the passage of x-rays 96. According to embodiments, x-ray transmission window 100 may comprise beryllium or a beryllium alloy. Alternatively, x-ray transmission window 100 may comprise a non-beryllium bearing alloy, such as stainless steel, titanium, or a titanium alloy, for example.

Referring now to FIGS. 5-8, electron collector 11 is shown according to embodiments of the invention. FIGS. 5-8 discuss common elements and components of electron collector 11 relative to the same reference numbers.

Figure 5:
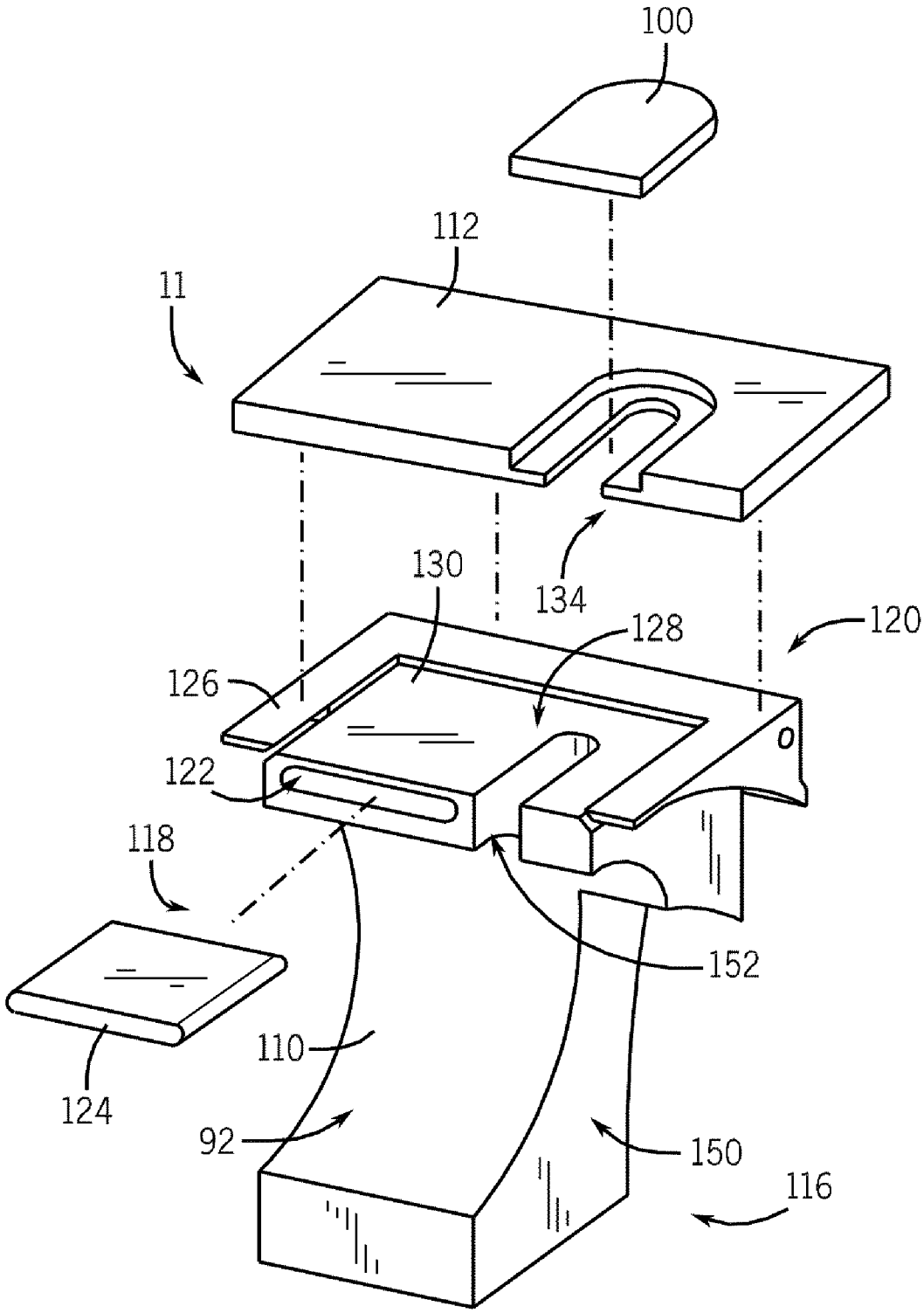
FIG. 5 is an exploded cross-sectional perspective view an electron collector assembly in accordance with an embodiment of the present invention.

Referring first to FIG. 5, an exploded cross-sectional perspective view of electron collector 11 is shown according to an embodiment of the invention. As illustrated, electron collector 11 includes a collector body 110 and a cover plate 112, which has a transmission window 100 disposed therein. Collector body 110 includes an anode side 116 and a cathode side 118 opposite anode side 116. Internal bore 92 extends through collector body 110 between anode side 116 and cathode side 118. Collector body 110 also includes a window side 120 that faces x-ray transmission window 100.

A heat exchanger enclosure or pocket 122 is defined in collector body 110 and is sized to receive a heat exchange unit or heat exchange assembly 124, such as, for example, a fin pack for cooling collector body 110. According to one embodiment, heat exchanger enclosure 122 is positioned within collector body 110 adjacently to window side 120 and anode side 116 of collector body 110. However, one skilled in the art will readily recognize that heat exchanger enclosure 122 may be positioned at any location within collector body 110 wherein temperature regulation may be beneficial. Further, multiple fin packs may be positioned at various locations within collector body 110, according to alternative cooling strategies.

Window side 120 of collector body 110 comprises a first portion 126 and a second portion 130. First portion 126 of window side 120 defines an outer perimeter of window side 120. Second portion 130 is recessed from first portion 126, in one embodiment, in a direction toward internal bore 92 and perpendicular to a central axis 132 (shown in FIG. 7) of bore 92. The space between second portion 130 of collector body 110 and a bottom surface 134 of cover plate 112 defines a gap 136 (shown in FIGS. 6-8) therebetween.

Figure 6:
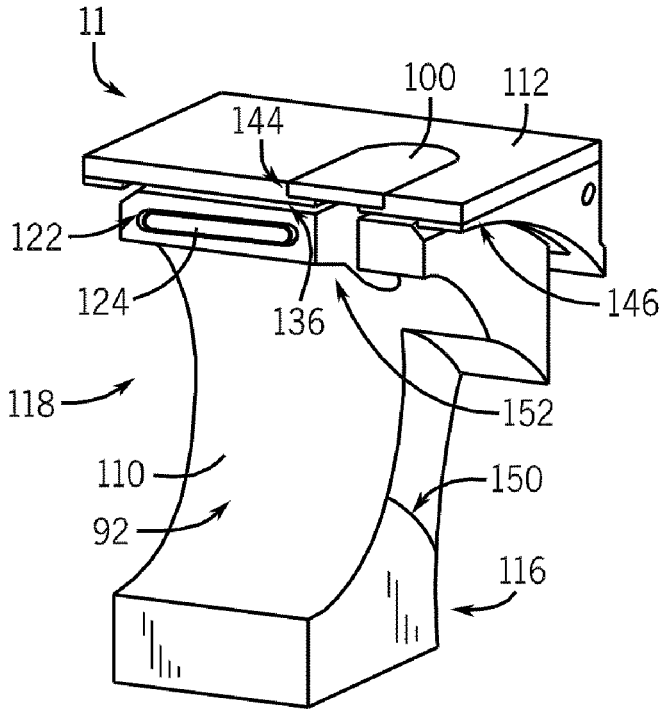
FIG. 6 is a cross-sectional top perspective view of an electron collector assembly in accordance with an embodiment of the present invention.
Figure 7:
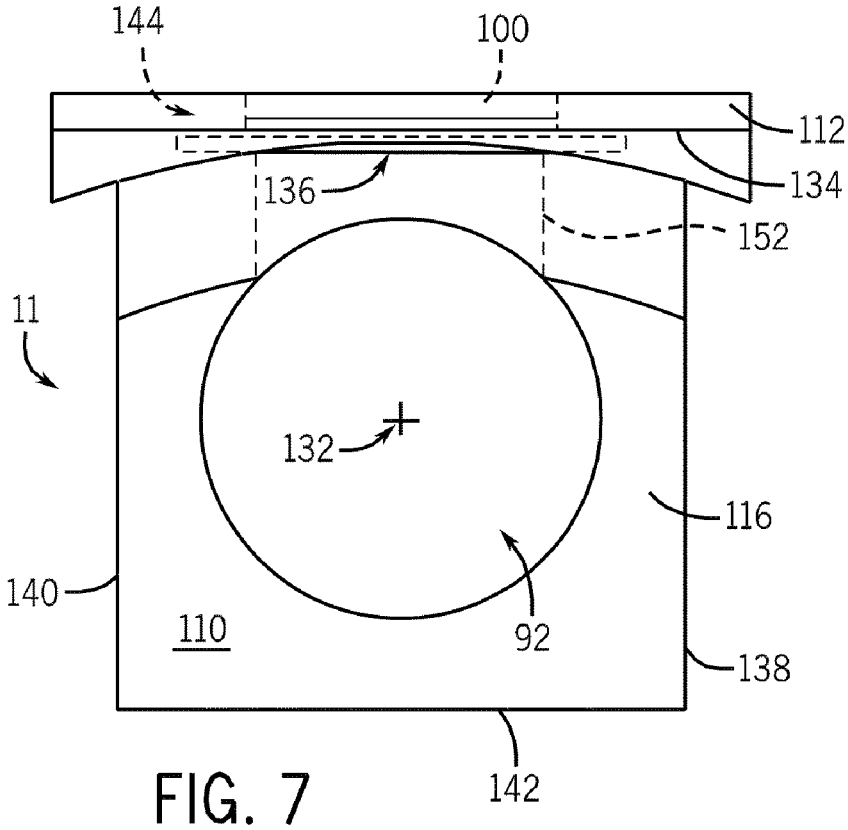
FIG. 7 is a side plan view of an electron collector assembly in accordance with an embodiment of the present invention.

Referring now to FIGS. 6 and 7, electron collector 11 is illustrated in an assembled state. FIG. 6 provides a perspective cross-sectional view of electron collector 11, and FIG. 7 is a side plan view of electron collector 11. As illustrated, electron collector is generally cubical in shape and includes three sides 138, 140, 142 between anode side 116 and cathode side 118. Transmission window 100 is hermetically sealed to cover plate 112 at a joint 144, such as by vacuum brazing, diffusion bonding, friction welding, or application of a hermetic-capable adhesive seal, for example. Likewise, a joint 146 hermetically seals cover plate 112 to collector body 110. Together, joints 144, 146 serve to maintain a vacuum within vacuum vessel 86.

Figure 8:
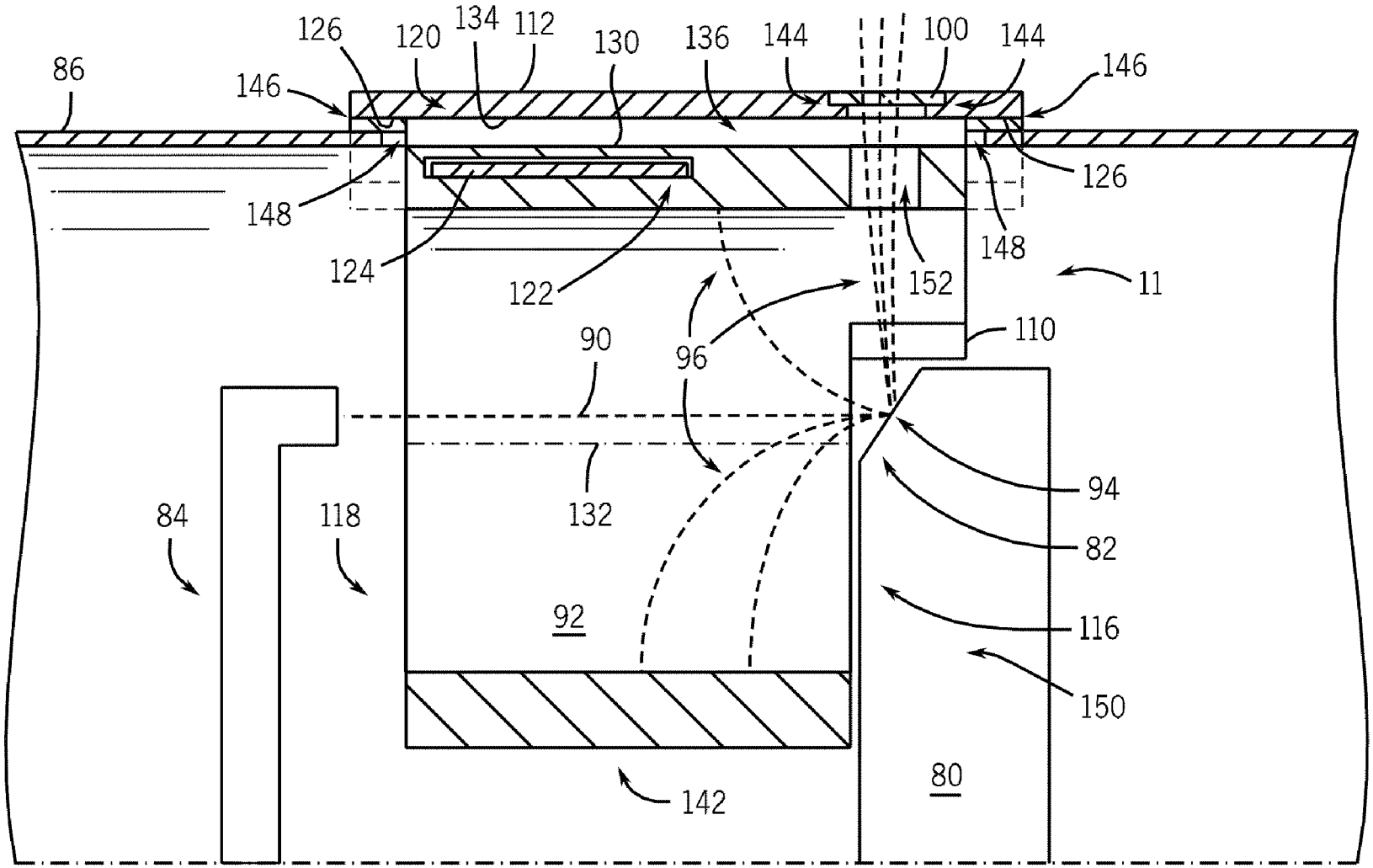
FIG. 8 is a cross-sectional view of an electron collector assembly incorporated within an x-ray tube in accordance with an embodiment of the present invention.

FIG. 8 is a cross-sectional view of electron collector 11 coupled to vacuum vessel 86. A joint 148 hermetically seals collector body 110 to vacuum vessel 86. As shown, anode side 116 of collector body 110 includes an anode receiving area 150 within which anode 80 may be positioned adjacently to electron collector 11. Cathode assembly 84, electron collector 11, and anode 80 are arranged such that stream of electrons 90 strikes focal spot 94 and a portion of resulting x-rays 96 are directed toward x-ray transmission window 100. While stream of electrons 90 is illustrated as being offset from central axis 132 of bore 92, one skilled in the art will readily recognize that cathode assembly 84 may be configured to direct stream of electrons 90 along central axis 132 or any other desired projection line within bore 92.

Also shown in FIG. 8 is an aperture 152, which extends from internal bore 92 to window side 120 of collector body 110 in a direction perpendicular to central axis 132 of bore 92. Aperture 152 is positioned within collector body 110 to be aligned with x-ray transmission window 100 such that x-rays 96 from focal spot 94 pass therethrough.

Figure 9:
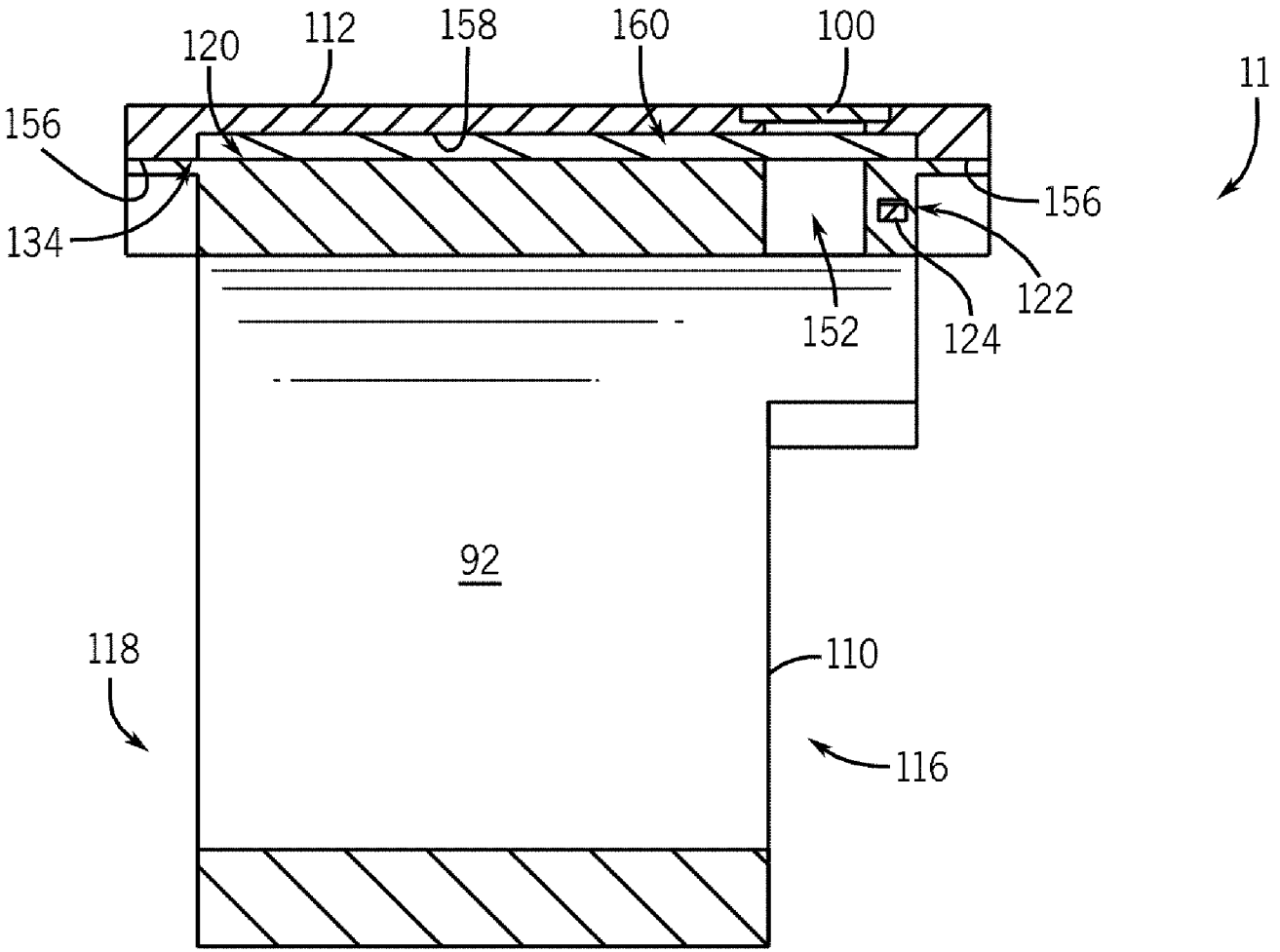
FIG. 9 is a cross-sectional view of an electron collector assembly in accordance with another embodiment of the present invention.

FIG. 9 is a cross-sectional view of electron collector 11 according to another embodiment of the invention. As illustrated, bottom surface 134 of cover plate 112 includes a first portion 156 that is coupled to first portion 126 of window side 120 of collector body 110. A second portion 158 of bottom surface 134 is recessed from first portion 156 in a direction away from internal bore 92 and toward x-ray transmission window 100. The space between collector body 110 and second portion 158 of bottom surface 134 defines a gap 160 therebetween. Aperture 152 is aligned with second portion 158 of bottom surface 134 of cover plate 112.

According to one embodiment, heat exchange element 124 is positioned within heat exchanger enclosure 122, which is positioned at anode side 116 of electron collector body 110. However, one skilled in the art will recognize that heat exchange element 124 may be positioned at alternative locations based on a desired cooling characteristic.

In operation, the resulting separation between window 100 and collector body 110 together with the vacuum present within vacuum vessel 86 thermally isolate window 100 from the high temperatures present within collector body 110. That is, the geometry of electron collector 11 is such that the conductive heat transfer path between window 100 and collector body 110 is sufficiently long enough to effectively thermally isolate window 100 and associated joint 144 from any areas of high temperature within collector body 110. Further, due to the two-piece construction of electron collector 11 (i.e., cover plate 112 coupled to collector body 110), mechanical stresses resulting from any temperature difference between collector body 110, cover plate 112, and window 100 are experienced primarily in joint 146 between collector body 110 and cover plate 112, rather than in joint 144 between window 100 and cover plate 112. Thus, joint 144 of transmission window 100 is effectively mechanically isolated from the non-symmetric heat load and associated thermal growth of collector body 110, thereby reducing the plastic strain in joint 144.

Figure 10:
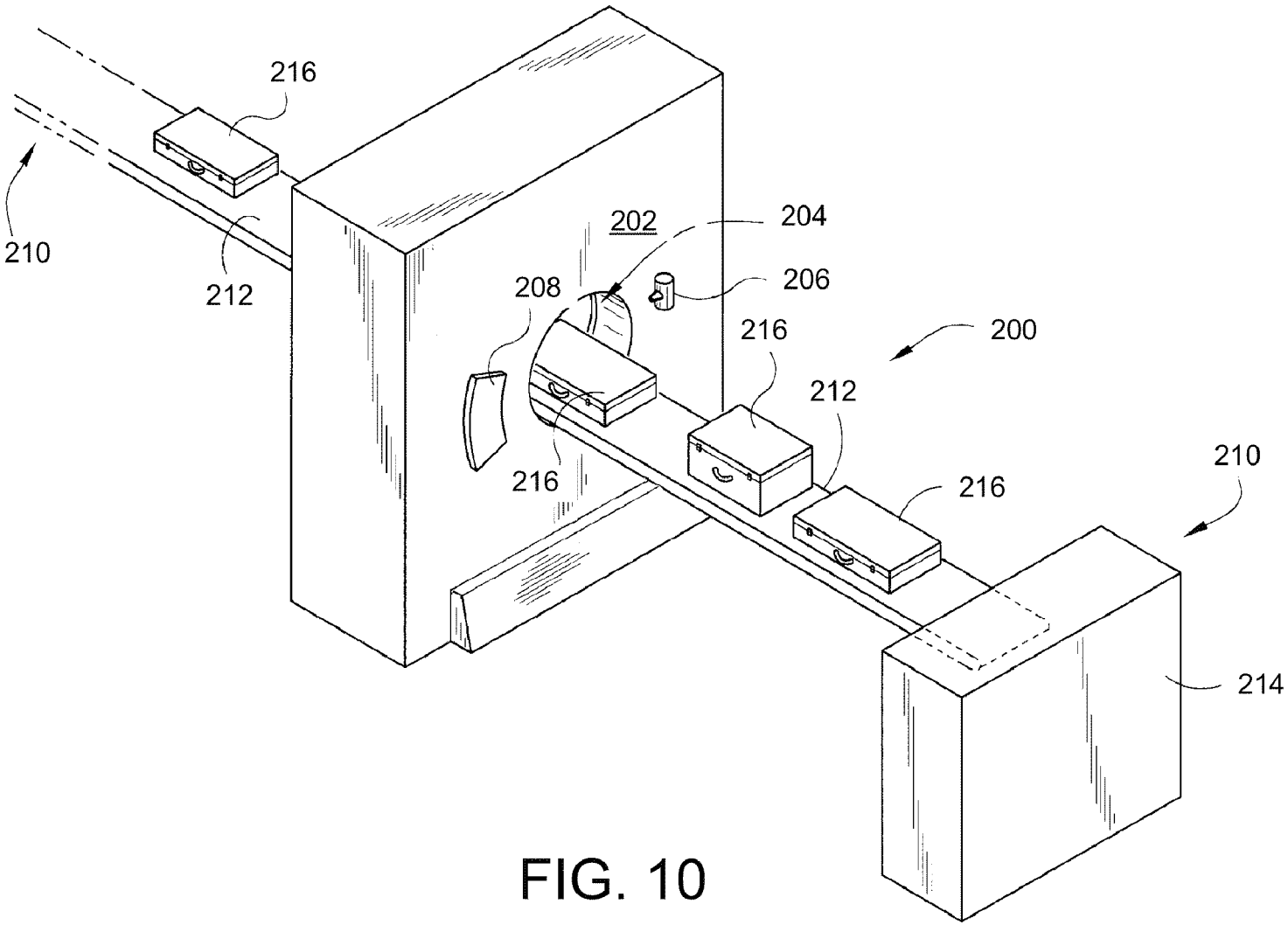
FIG. 10 is a pictorial view of a CT system for use with a non-invasive package inspection system.

Referring now to FIG. 10, package/baggage inspection system 200 includes a rotatable gantry 202 having an opening 204 therein through which packages or pieces of baggage may pass. The rotatable gantry 202 houses a high frequency electromagnetic energy source 206 as well as a detector assembly 208. A conveyor system 210 is also provided and includes a conveyor belt 212 supported by structure 214 to automatically and continuously pass packages or baggage pieces 216 through opening 204 to be scanned. Objects 216 are fed through opening 204 by conveyor belt 212, imaging data is then acquired, and the conveyor belt 212 removes the packages 216 from opening 204 in a controlled and continuous manner. As a result, postal inspectors, baggage handlers, and other security personnel may non-invasively inspect the contents of packages 216 for explosives, knives, guns, contraband, etc.

Therefore, in accordance with one embodiment, an apparatus includes an electron collector includes a body having an internal bore formed therethrough along a first direction and a window side having an aperture formed in a first portion thereof along a second direction different from the first direction. The apparatus also includes a cover plate having a bottom surface coupled to a second portion of the first surface of the electron collector, and an x-ray transmission window coupled to the cover plate and aligned with the aperture along the second direction, wherein a recess is formed along the second direction in one of the first portion of the first surface of the electron collector and a portion of the bottom surface of the cover plate, and wherein a gap is formed between the bottom surface of the cover plate and the first surface of the electron collector.

In accordance with another embodiment, a method of fabricating an assembly includes providing a thermal storage body having a bore formed therein in a first direction to allow an electron beam to pass therethrough and having a window side surface oriented parallel to a central axis of the bore, wherein the window side surface comprises a first portion and a second portion, and wherein an aperture is formed between the bore and the second portion of the window side surface. The method also includes coupling a first portion of a bottom surface of a cover plate to the first portion of the window side surface of the thermal storage body such that an internal pocket is formed between a second portion of the bottom surface of the cover plate and the second portion of the window side surface of the thermal storage body, and disposing an x-ray transmission window in the cover plate.

In accordance with yet another embodiment, an apparatus includes a vacuum chamber, a cathode positioned within the vacuum chamber and configured to emit electrons, and an anode positioned within the vacuum chamber to receive the electrons emitted from the cathode and configured to generate a beam of x-rays from the electrons. The apparatus also includes an electron collector configured to allow passage of the beam of x-rays therethrough. The electron collector includes a collector body having an anode side, a cathode side, and a window side adjacent to the anode and cathode sides, wherein a bore is formed between the anode side and the cathode side, and wherein the window side comprises a window surface having a first portion and a second portion, the second portion having an aperture formed therein. The electron collector also includes a plate having a first surface portion and a second surface portion, wherein the first surface portion is coupled to the first portion of the window surface of the collector body, and wherein a vacuum gap is formed between the second surface portion of the plate and the second portion of the window surface of the collector body, and a window disposed in the plate and positioned to allow a portion of the beam of x-rays to pass therethrough.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus comprising:

an electron collector comprising:

a body having an internal bore formed therethrough along a first direction; and a window side having an aperture is formed in portion along a second direction different from the first direction;

a cover plate having a bottom surface coupled to the first portion of the window side of the electron collector; and an x-ray transmission window coupled to the cover plate and aligned with the aperture along the second direction;

wherein a recess is formed along the second direction in one of the second portion of the window side of the electron collector and a portion of the bottom surface of the cover plate; and wherein a gap is formed between the bottom surface of the cover plate and the window side of the electron collector.

2. The apparatus of claim 1 wherein the body, cover plate, and x-ray transmission window are arranged such that the x-ray transmission window is thermally isolated from the second portion of the window side of the electron collector via the gap and mechanically isolated from the body via the gap between the body and the cover plate.

3. The apparatus of claim 2 wherein the x-ray transmission window is coupled to the cover plate via a braze joint.

4. The apparatus of claim 1 wherein the x-ray transmission window comprises one of beryllium, a beryllium alloy, and a non-beryllium bearing alloy.

5. The apparatus of claim 1 wherein the body comprises:

an anode side adjacent to the window side of the body; and a cathode side opposite the anode side, wherein the internal bore extends between the anode side and the cathode side.

6. The apparatus of claim 1 further comprising a heat exchange element encapsulated within the body at a location adjacent to the second portion of the window side of body.

7. The apparatus of claim 6 wherein the heat exchange element is positioned adjacent to a cathode-side surface of the body.

8. The apparatus of claim 6 wherein the heat exchange element is positioned adjacent to an anode-side surface of the body.

9. The apparatus of claim 6 wherein the heat exchange element comprises a fin pack.

10. The apparatus of claim 1 wherein the recess is formed in the second portion of the window side of the electron collector along the second direction.

11. A method of fabricating an assembly comprising:

providing a thermal storage body having a bore formed therein in a first direction to allow an electron beam to pass therethrough and having a window side surface oriented parallel to a central axis of the bore, wherein the window side surface comprises a first portion and a second portion, and wherein an aperture is formed between the bore and the second portion of the window side surface;

coupling a first portion of a bottom surface of a cover plate to the first portion of the window side surface of the thermal storage body such that an internal pocket is formed between a second portion of the bottom surface of the cover plate and the second portion of the window side surface of the thermal storage body; and disposing an x-ray transmission window in the cover plate.

12. The method of fabricating an assembly of claim 11 wherein coupling the cover plate comprises positioning the thermal storage body, the cover plate, and the x-ray transmission window such that the x-ray transmission window is aligned with the aperture and a portion of the internal pocket is between the aperture and the x-ray transmission window.

13. The method of fabricating an assembly of claim 11 further comprising:

providing a vacuum housing;

disposing an anode and cathode within the vacuum housing; and arranging the thermal storage body between the anode and cathode within the housing.

14. The method of fabricating an assembly of claim 11 wherein coupling the cover plate comprises coupling the first portion of the bottom surface of the cover plate to the first portion of the window side surface of the thermal storage body via one of a braze joint, diffusion bonding, friction welding, and a hermetic-capable adhesive seal.

15. The method of fabricating an assembly of claim 11 wherein coupling the cover plate comprises coupling the cover plate to the window side surface of the thermal storage body via one of a braze joint, a diffusion bond, a friction weld, and a hermetic-capable adhesive seal.

16. The method of fabricating an assembly of claim 11 further comprising enclosing a fin pack within the thermal storage body at a position adjacent to the second portion of the window side surface of the thermal storage body.

17. An apparatus comprising:

a vacuum chamber;

a cathode positioned within the vacuum chamber and configured to emit electrons;

an anode positioned within the vacuum chamber to receive the electrons emitted from the cathode and configured to generate a beam of x-rays from the electrons; and an electron collector configured to allow passage of the beam of x-rays therethrough, the electron collector comprising:

a collector body having an anode side, a cathode side, and a window side adjacent to the anode and cathode sides, wherein a bore is formed between the anode side and the cathode side, and wherein the window side comprises a window surface having a first portion and a second portion, the second portion having an aperture formed therein;

a plate having a first surface portion and a second surface portion, wherein the first surface portion is coupled to the first portion of the window surface of the collector body, and wherein a vacuum gap is formed between the second surface portion of the plate and the second portion of the window surface of the collector body; and a window disposed in the plate and positioned to allow a portion of the beam of x-rays to pass therethrough.

18. The apparatus of claim 17 further comprising:

one of a collector braze joint, one of a braze joint, a diffusion bond, a friction weld, and a hermetic-capable adhesive seal coupling the collector body to the plate; and one of a collector braze joint, one of a braze joint, a diffusion bond, a friction weld, and a hermetic-capable adhesive seal coupling the window to the plate.

19. The apparatus of claim 18 wherein the window is positioned at a location in the plate such that the window is thermally isolated from collector body via the vacuum gap and mechanically isolated from the collector body via the gap.

20. The apparatus of claim 17 wherein a recess is formed in the second portion of the window surface of the collector body.

21. The apparatus of claim 17 further comprising a heat sink assembly enclosed within the collector body and positioned adjacent to the window side of the collector body.

* * * * *

UNITED STATES PATENT AND TRADEMARK OFFICE

CERTIFICATE OF CORRECTION

PATENT NO. : 8,121,259 B2
APPLICATION NO. : 12/630326
DATED : February 21, 2012
INVENTOR(S) : Hebert et al.

It is certified that error appears in the above-identified patent and that said Letters Patent is hereby corrected as shown below:

Col. 7, line 39 (Claim 1), delete "having an aperture is formed in portion" and substitute therefore -- having a first portion and a second portion, wherein an aperture is formed in the second portion --.

Signed and Sealed this
Fifteenth Day of May, 2012

David J. Kappos

David J. Kappos
*Director of the United States Patent and Trademark Office*